United States Patent [19]

Chielens et al.

[11] Patent Number: 4,483,387

[45] **Date of Patent: * Nov. 20, 1984**

[54] METHOD OF CONTROLLING COOLING OF A CONTINUOUS CASTING

[75] Inventors: Alain Chielens, Marcq en Baroeul; Philippe Benoit; Bernard Roggo, both of Lambersart, all of France

[73] Assignee: Fives-Cail Babcock, Paris, France

[ * ] Notice: The portion of the term of this patent subsequent to Aug. 7, 2001 has been disclaimed.

[21] Appl. No.: 421,451

[22] Filed: Sep. 22, 1982

Related U.S. Application Data

[63] Continuation-in-part of Ser. No. 242,143, Mar. 9, 1981.

[30] Foreign Application Priority Data

Oct. 2, 1981 [FR] France ..... 81 18586

[51] Int. Cl.[3] ..... B22D 11/16; B22D 11/124

[52] U.S. Cl. ..... 164/455; 164/414

[58] Field of Search ..... 164/414, 444, 455, 484

[56] References Cited

U.S. PATENT DOCUMENTS 3,478,808 11/1969 Adams ..... 164/453

3,915,216 10/1975 Fekete ..... 164/4.1

4,073,332 2/1978 Etienne ..... 164/4.1

*Primary Examiner*—Kuang Y. Lin

*Assistant Examiner*—Richard K. Seidel

*Attorney, Agent, or Firm*—Kurt Kelman

[57] ABSTRACT

To permit a method of controlling the cooling of a cast product in a continuous casting installation to be effected at the beginning of casting, it is proposed to calculate periodically the value of the quantity of cooling water delivered at the start of casting to one of the cooling sections between the moments when an end of the cast product enters and leaves the one cooling section, the latter value being calculated by integrating the values of the quantities of cooling water calculated for the elements in the one cooling section and a fictitious portion of the cast product occupying a part of this one section between a downstream end thereof and the end of the cast product, said fictitious portion having a fictitious age determined as a function of the position of said portion in the casting installation and a fictitious extraction speed equal to the average of the average extraction speeds of the fictitious elements of the cast product in the one cooling section.

2 Claims, 1 Drawing Figure

METHOD OF CONTROLLING COOLING OF A CONTINUOUS CASTING

Figure 1:
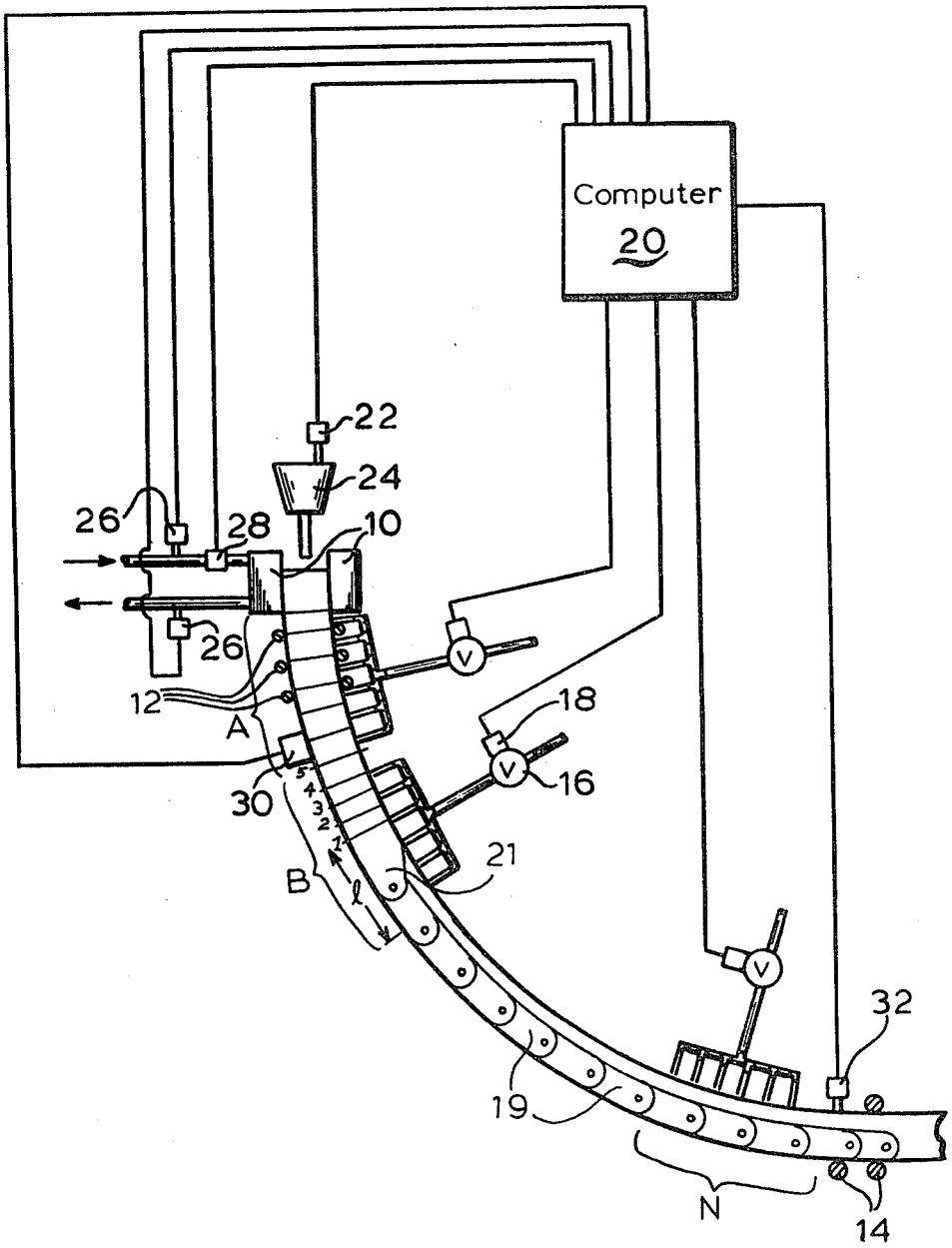

This is a continuation-in-part of our copending U.S. patent application Ser. No. 242,143, filed Mar. 9, 1981, and the entire disclosure thereof is incorporated herein by way of reference.

The present invention relates to improvements in a method of controlling cooling of a cast product in a continuous casting installation comprising a secondary cooling zone including a succession of cooling sections through which the cast product is guided and extracted.

In the cooling method disclosed in the copending application, the cast product is divided into fictitious elements, cooling water is delivered in predetermined quantities to each one of the fictitious elements and values of the quantities of delivered cooling water are periodically calculated as a function of the respective ages of the elements, the values are integrated for all the elements in each one of the cooling sections to determine the value of the quantity of cooling water delivered to each cooling section, and the quantities of cooling water delivered to the cooling sections are controlled to maintain them at the respective calculated values.

This cooling control method cannot be utilized at the start of casting when the cast product is only partially guided in the cooling zone because the value of the quantity of cooling water delivered to a given cooling section and calculated in the above-indicated manner is valid only when the cast product occupies the entire cooling section in question. During the entire period when an end of the cast product is positioned between the ends of a cooling section of the cooling zone, it is, therefore, impossible to determine the value of the quantity of cooling water to be delivered by the method disclosed in the copending application.

It is the primary object of this invention to improve this method of controlling cooling of a continuous cast product so as to make it applicable to the start of the casting operation.

The above and other objects are accomplished according to the invention by the step of periodically calculating the value of the quantity of cooling water delivered at the start of casting to one of the cooling sections between the moments when an end of the cast product enters and leaves the one cooling section, the latter value being calculated by integrating the values of the quantities of cooling water calculated for the elements in the one cooling section and a fictitious portion of the cast product occupying a part of this one section between a downstream end thereof and the end of the cast product, said fictitious portion having a fictitious age determined as a function of the position of said portion in the casting installation and a fictitious extraction speed equal to the average of the average extraction speeds of the fictitious elements of the cast product in the one cooling section.

The calculation of the value of the quantity of cooling water to be delivered to the fictitious cast product portion is effectuated in the same manner as that for the fictitious elements of the cast product, as disclosed in the copending application, with the aid of a computer and two curves respectively giving the variations of the quantity of heat extracted from a unitary mass of the cast product and the surface temperature of one cast product element as a function of its age, a fictitious quantity of heat and surface temperature corresponding to the fictitious age attributed to the cast production portion. With the values thus determined, a fictitious thermal exchange coefficient and then a specific quantity of cooling water delivered is calculated, a relation between the two parameters is established with the aid of a third curve, and the specific quantity of cooling water is multiplied by the side surface of the fictitious cast product portion, or merely a fraction of this surface, depending on the disposition of the cooling water spray nozzles in the cooling zone.

To determine the fictitious speed of the fictitious cast product portion passing through the cooling zone through which it is guided as the product is extracted from the mold, the average speed of each cast product element in the cooling zone section under consideration and its age is calculated according to its position in the continuous casting installation, and the average of all the average speeds of the elements is then established. This average may take into account, for example, the lengths of the cast product elements.

The above and other objects, advantages and features of the present invention will become more apparent from the following detailed description of a now preferred embodiment thereof, taken in conjunction with the single FIGURE of the accompanying drawing of an installation capable of carrying out the cooling control method.

Referring now to the drawing, there is shown a generally conventional continuous casting installation for casting steel slabs, by way of example, which comprises tundish 24 delivering molten metal into water-cooled mold 10 whence emerges a continuous cast product which passes through guide-roll rack 12 to slab straightener 14. The guide-roll rack constitutes a cooling zone divided into a succession of cooling sections A, B . . . N for the cast product. For this purpose, water spray headers are disposed along the rack, the spray nozzles or ramps of each header receiving a flow of water from a water delivery conduit to which the nozzles or ramps are connected in parallel. The water flow delivery to each header is controlled by valve 16 whose opening is controlled by control 18. An output of computer 20 is connected to control 18 and delivers thereto a control signal so that the flow of water to the water spray header is determined by the control signal from computer 20. The water spray nozzles or ramps may be distributed all around the cast product as it passes through guide-roll rack 12 or, if a slab of rectangular cross section is cast, they may be disposed solely facing the two large faces of the slab. Manually operable means are provided for distributing the total flow of water delivered to each header to the different nozzles or ramps.

To start the casting operation, dummy or starter bar 19 is used, head 21 of the bar sealing the open bottom of mold 10 until the metal in the mold has attained a predetermined level. The dummy bar is then displaced downwardly and pulls the cast product along to rolls 14.

As has been disclosed in the copending application, the cooling control system incorporated into the installation includes specific measuring devices monitoring the casting operation and connected to computer 20 to transmit input signals thereto.

Thermocouple 22 measures the temperature of the molten metal in tundish 24 and feeds a corresponding input signal to the computer.

Heat-measuring probes 26 measure the temperature of the water used to cool mold 10 at the inlet and outlet of the mold cooling system, respectively, and feed corresponding input signals to the computer.

Flowmeter 28 measures the flow of cooling water passing through the mold cooling system and feeds a corresponding input signal to the computer.

Pulse generator 30 measures the speed of extraction (casting speed) of the slab and calculates the age of fictitious elements of the slab passing by the pulse generator, feeding a corresponding input signal to the computer.

Finally, pyrometer 32 measures the surface temperature of the slab in the range of slab straightener 14 at the end of the cooling zone and feeds a corresponding input signal to the computer.

On the basis of these input signals corresponding to the described operating parameters of the continuous casting and predetermined constants stored in the memory of the computer, computer 20 at regular intervals generates output signals to controls 18 of valves 16 controlling the quantity of cooling water delivered to each water-spray header so as to determine the water flow to the different sections A, B . . . N of the cooling zone. The regular time interval between the control signals generated by the computer may be, for example, one to fifty seconds.

The principle of the cooling control according to the method disclosed in the copending application is to maintain a predetermined progression of the solidification of the slab, regardless of the specific operation of the continuous casting installation. For this purpose, the control signal from the computer is subject to equation $C=f(t)$, which is a law of variation of the quantity of heat C extracted from the slab per weight (kilogram) of steel, as a function of the dwell time t in the installation, and equation $T=g(t)$, which is a law of variation of the surface temperature T of the slab, also as a function of the dwell time t in the installation. The two curves expressing these laws depend essentially on the type of steel cast, the shape of the slab or billet and the casting speed. In practice, for a given shape of the cast product, the types of steel and the casting speeds will be grouped in different classes.

All the curves are defined by parametric equations or by point values introduced into the memory of the computer. The constants determined by the type of steel and the shape of the cast product are introduced into the computer before each casting to permit the computer to select the set of corresponding curves. The casting speed is permanently measured by pulse generator 30 and the computer selects at each moment the set of curves corresponding to the average casting speed derived from the measurements of pulse generator 30.

From the selected set of curves, computer 20 can calculate, at every moment, coefficient K of surface thermal exchange for each element of the slab, on the basis of the extracted quantity C of heat and slab-surface temperature T, and generate a corresponding control signal to determine a specific flow q of cooling water to be delivered by spraying or the like onto a surface unit of the slab element considered, with the aid of a curve $K=h(q)$ stored in the memory of the computer. This curve may apply to the entire cooling zone or it may be constituted by several distinct curve sections each applicable to a different section of the cooling zone.

The calculation is effected in computer 20 periodically, for example every 10 seconds, and the cast product is divided into fictitious elements whose length is that of the portion of the cast product in the time interval between successive calculations. The number of the order assigned to each element of the cast product from its time of production thus permits the age of each such element and its position in the casting installation to be known at every moment.

The specific flow q of cooling water makes it possible to compute the quantity $Q=q\times S$ of cooling water flow delivered or sprayed onto the lateral surface of each cast product element.

After the water flow to be projected against each cast product element present at a given moment in the cooling zone has thus been calculated, the values of the water flow quantities feeding the different sections of the cooling zone are computed by integration and the computed values are transmitted from the computer to respective controls 18.

In case the nozzles or other cooling water spray means deliver the water in finely divided droplets produced by air pressure, the total flow of water in the cooling zone is computed and the flow of air is deduced therefrom by means of an equation or a curve establishing a relation between the water flow and the flow of pressurized air. Manual means controls the distribution between the different cooling zone sections of the total air flow fed to the cooling zone.

The above-described cooling control method, which has been more fully disclosed in the copending application, is not applicable to the start of the casting operation in the cooling zone section B where the leading end of the cast product has been introduced into this section and the cast product, in fact, occupies only a part of the section. If a fictitious end portion of the cast product between the downstream end of section B and the end of the cast product were not taken into consideration, the quantity of cooling water delivered to this section would be too small.

To remedy this and to improve our previously disclosed cooling control method, we propose according to the present invention to associate a fictitious portion of the cast product in this section with fictitious elements 1, 2, 3, 4, 5 of the cast product, the length l of the fictitious cast product portion being the length of section B not yet occupied by the cast product, to compute the value of the quantity of cooling water to be delivered or projected on this fictitious portion in the same manner as this is computed for the fictitious elements, and to add this value to the values computed for the elements of the cast product in this cooling zone section to determine the value of the quantity of cooling water required for the section.

To compute the cooling water quantity which would have to be projected onto the fictitious cast product portion, a fictitious age is assigned to this portion, which age is determined as a function of the position of the portion in the casting installation and a fictitious casting speed equal to the average of the average casting speeds of the fictitious elements of the cast product in this cooling zone section. For example, this average may be established by taking into account the lengths of the fictitious cast product elements, applying the formula $$V_f = \frac{\sum_{n}^{1} V_{mi \cdot li}}{n \sum_{n}^{1} li}, \text{ where}$$

$V_f$=fictitious casting speed $V_{mi}$=average casting speed of element i li=length of element i n=number of elements in the section To determine the fictitious age of the fictitious cast product portion, the distance of this portion from the upper level of the molten metal in the mold, which is a parameter known in computer 20, is divided by the fictitious casting speed computed as indicted hereinabove. It is thus possible to compute the values C, T, K, q and Q for the fictitious cast product portion, its length and, subsequently, its lateral surface being known by the computer.

This manner of computing the values of the quantities of cooling water to be delivered to respective ones of the cooling zone sections is successively utilized for sections A, B . . . N of the secondary cooling zone as the cast slab moves through the installation at the start of the casting operation. As soon as the leading end of the slab leaves a respective one of the sections, i.e. when the cast product entirely occupies the respective section, the general control program disclosed in our copending application is utilized.

What we claim is:

1. In a method of controlling cooling of a cast product in a continuous casting installation comprising a mold and a secondary cooling zone including a succession of cooling sections through which the cast product is guided, wherein the cast product is fictitiously divided into elements and flows of cooling water are delivered to successive ones of the cooling sections at respective flow rates, the quantity C of heat to be extracted from each one of the cast product elements by the cooling water and the surface temperature T thereof are periodically determined by means of respective curves $C=f(t)$ and $T=g(t)$ giving the variations of C and T as a function of the age of the elements, a coefficient of thermal exchange is computed for each one of said elements on the basis of determined values C and T and then a specific water flow rate value is computed for each one of said elements, the values of the flow rate of water to be projected on each one of the elements in each successive cooling section is computed, the water flow rate values for the elements in each successive cooling section in the secondary cooling zone are integrated to determine the water flow rate values for each successive cooling section, and the delivery of cooling water to the successive cooling sections is controlled to maintain the water flow rates at the computed values, curve $C=f(t)$ being displaced parallel to a coordinate axis of time before each computation of the values of the water flow rate for each element until the curve passes through a point whose coordinates are, on the one hand, the total dwell time $t_1$ of the element in the mold and, on the other hand, the quantity $C_1$ of heat to be extracted from the element during the total dwell time in the mold: the step of determining heat quantity $C_1$ by periodically determining the total quantity of heat extracted from the cast product in the mold, distributing this total quantity of extracted heat over the used height of the mold according to a predetermined formula, deriving therefrom the quantity of heat to be extracted from each one of the cast product elements present in the mold at that moment, and computing the total quantity of heat to be extracted in the mold from each one of said elements at the point of emergence from the mold by adding the quantities of extracted heat periodically determined during the dwell time of the element in the mold.

2. In the method of claim 1, the fictitious speed of the fictitious cast product portion takes account of the lengths of the fictitious elements.

* * * * *